US007661997B2

(12) United States Patent
Wurster

(10) Patent No.: US 7,661,997 B2
(45) Date of Patent: Feb. 16, 2010

(54) PIN TO CB SYSTEM

(75) Inventor: Woody Wurster, 9655 Shadowstone Way, Reno, NV (US) 89521

(73) Assignee: Woody Wurster, Reno, NV (US)

( * ) Notice: Subject to any disclaimer, the term of this patent is extended or adjusted under 35 U.S.C. 154(b) by 668 days.

(21) Appl. No.: 11/519,634

(22) Filed: Sep. 12, 2006

(65) Prior Publication Data

US 2008/0060839 A1 Mar. 13, 2008

(51) Int. Cl.
*H01R 13/42* (2006.01)

(52) U.S. Cl. ..... 439/751

(58) Field of Classification Search ..... 439/751; 339/17

See application file for complete search history.

(56) References Cited

U.S. PATENT DOCUMENTS

| | | | | | |
|---|---|---|---|---|---|
| 3,685,002 | A | | 8/1972 | Kennedy | |
| 3,718,895 | A | * | 2/1973 | Reynolds et al. | 439/853 |
| 3,783,433 | A | | 1/1974 | Kurtz et al. | |
| 3,792,412 | A | * | 2/1974 | Madden | 439/82 |
| 4,080,037 | A | * | 3/1978 | Kunkle et al. | 439/853 |
| 4,181,387 | A | | 1/1980 | Walters | |
| 4,363,529 | A | * | 12/1982 | Loose | 439/82 |
| 4,469,394 | A | * | 9/1984 | Verhoeven | 439/873 |
| 4,526,429 | A | * | 7/1985 | Kirkman | 439/82 |
| 4,684,203 | A | | 8/1987 | Bihler | |
| 4,735,575 | A | * | 4/1988 | Shaffer | 439/82 |
| 4,820,207 | A | * | 4/1989 | Zic | 439/825 |
| 4,908,942 | A | * | 3/1990 | Long et al. | 29/882 |
| 5,137,454 | A | | 8/1992 | Baechtle | |
| 5,374,204 | A | * | 12/1994 | Foley et al. | 439/751 |
| 5,452,512 | A | * | 9/1995 | Foley et al. | 29/874 |
| 5,564,954 | A | | 10/1996 | Wurster | |
| 5,820,402 | A | * | 10/1998 | Chiacchio et al. | 439/398 |
| 5,860,817 | A | | 1/1999 | Fieberling et al. | |
| 5,910,031 | A | * | 6/1999 | Goto | 439/752.5 |
| 5,975,921 | A | | 11/1999 | Shuey | |
| 6,217,346 | B1 | | 4/2001 | Cubon | |
| 6,406,303 | B1 | * | 6/2002 | Kosmala | 439/63 |
| 6,634,911 | B1 | | 10/2003 | Billman et al. | |
| 6,685,484 | B2 | | 2/2004 | Keyser | |
| 6,997,757 | B2 | * | 2/2006 | Roshardt | 439/751 |
| 7,377,823 | B2 | * | 5/2008 | Chen | 439/751 |
| 2001/0041467 | A1 | | 11/2001 | Kikuchi et al. | |
| 2003/0114027 | A1 | * | 6/2003 | Wurster | 439/82 |
| 2003/0124886 | A1 | * | 7/2003 | Reisdorf et al. | 439/82 |

* cited by examiner

*Primary Examiner*—T C Patel
*Assistant Examiner*—Vladimir Imas
(74) *Attorney, Agent, or Firm*—Leon D. Rosen

(57) ABSTRACT

Contacts (16) of a circuit component (12) have contact top regions (30) that extend down close to the upper face of a circuit board, and have contact inboard regions (32) that each lies primarily in a plated circuit board hole (34), wherein each contact is formed of bent sheet metal. The contact has a box-shaped cross-section along most of its length, which includes rear and front walls (40, 41) and first and second side walls (42, 44). Along the inboard region, the first side wall has a forward extension (90) that is bent by 90° to form a front wall with a free edge (94) that lies against the front (52) of the second side wall. Along a lower portion of the top region the side walls have forward projections (64, 66) that form upper shoulders (60, 62) for receiving downward forces to press the inboard portions down into the circuit board holes.

13 Claims, 3 Drawing Sheets

16
A
134
54
A
46
30
41
40
42
44
50
52
62
60
B
64
66
98
100
102
32
82
80
84
90
94
92
52
95
R
F
L 20
14
30
12
10
16
38
37
34
18
32

60,62
61
30
38
E
37
46
74
80
32
4
4
90
34
36
95

82s
82
E
36
34
90
C
80
D
G
95
32
F
P
L
96
94
84
84s

FIG.5
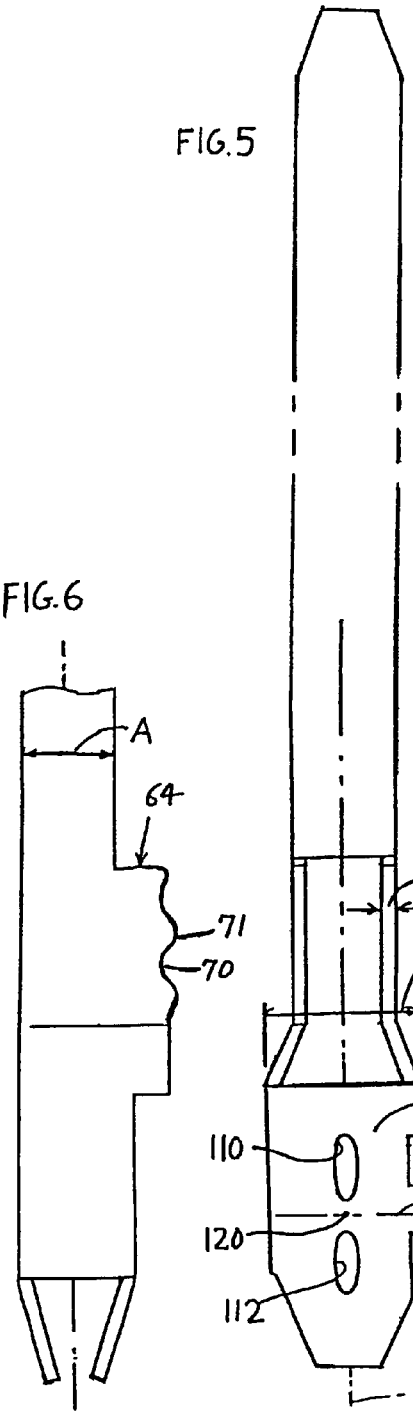
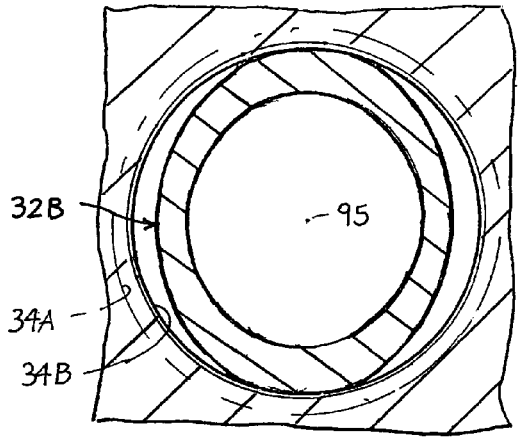
FIG. 4B
FIG.6
FIG.7
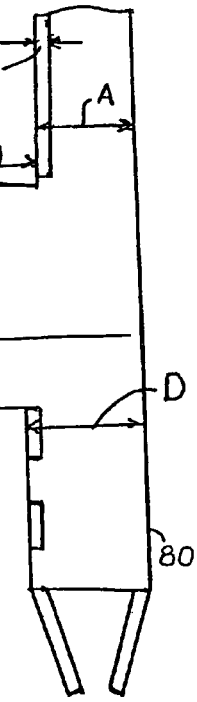
FIG.8
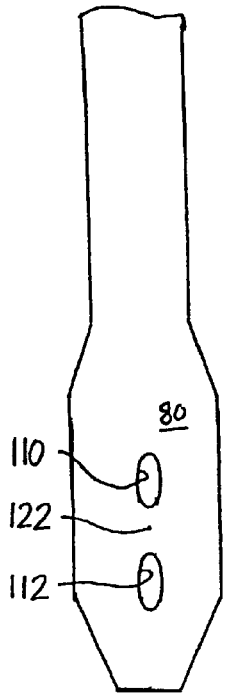

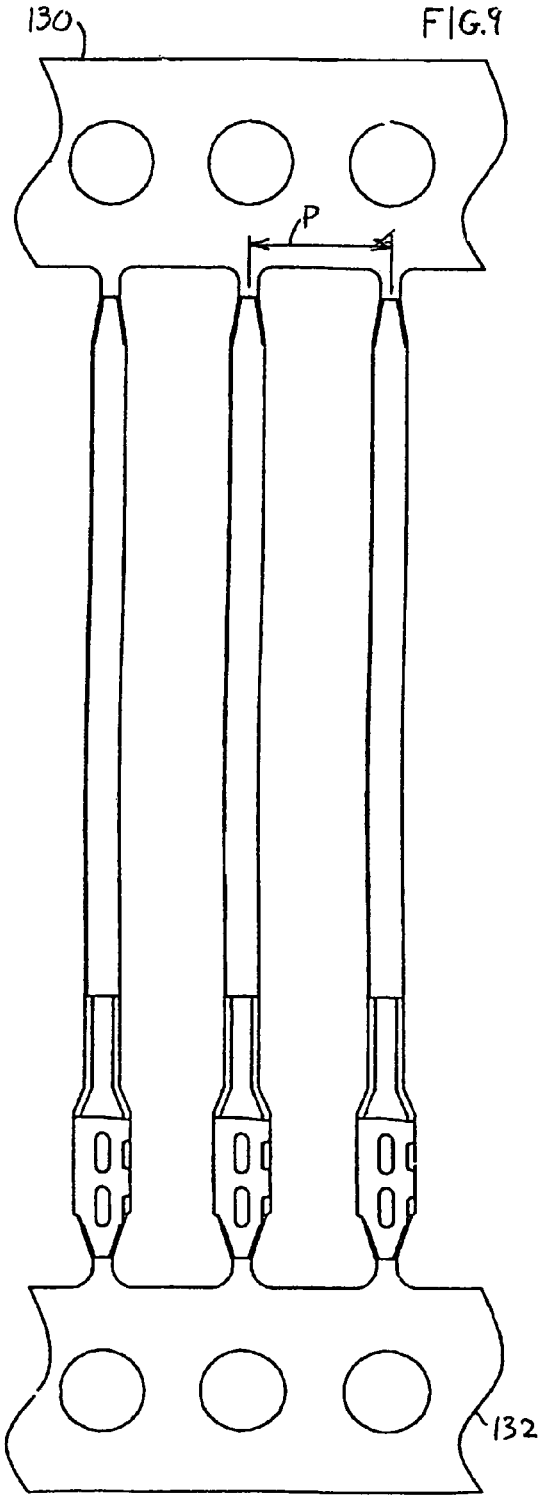
FIG.9
FIG.10
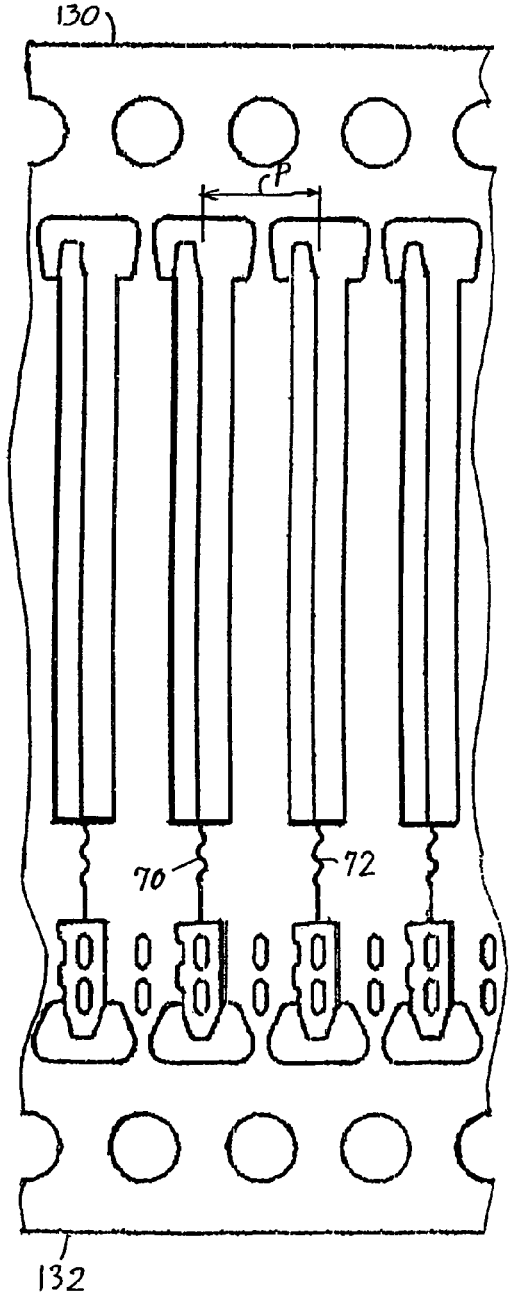

PIN TO CB SYSTEM

BACKGROUND OF THE INVENTION

Circuits often have components with a large number of contacts that extend into plated holes in the circuit board. The contacts are usually formed of copper and a large number are used in airplanes and automobiles and other equipment that includes electronics. Contacts formed of bent sheet metal are becoming more desirable to reduce the amount of copper required and to reduce the weight of the circuit board assemblies, as the prices of copper and vehicle fuel increase. However, bent sheet metal contacts should be constructed to enable easy insertion of inboard contact portions into the circuit boards, and to provide contact inboard portions that assure good contact with the walls of the plated hole without requiring soldering.

SUMMARY OF THE INVENTION

In accordance with one embodiment of the invention, a contact and a combination of contacts and a circuit board with plated holes are provided, wherein the contact is formed of bent sheet metal, provides good contact with the walls of the board hole and facilitates installation into the board hole. The contact has a top region that extends down from the housing of a circuit component, and has an inboard region that lies primarily in the plated hole of the circuit board. The contact is of basically box shape, with rear and front walls, and with a pair of opposite side walls.

Along a bottom portion of the top region, which lies a short distance above the top face of the circuit board, the opposite side walls have forward projections that form upwardly-facing shoulders that can be pressed down to install the contact inboard region into the board hole.

Along part of the inboard region, a first of the side walls has a projection, or extension, that is bent 90° to extend to the front edge of the second side wall and form a front wall. A free end of the extension contacts the front edge of the second side wall. The inboard region has an elongated largely rectangular cross section. The front and rear walls have holes above and below a horizontal centerplane of the inboard region to increase resilience in compression.

The front and rear walls along the inboard region are coined to a decreased thickness, to increase their resilience and increase their length. The increased length allows contacts to be produced at a 0.100 inch pitch along a carrier, and provides sufficient length of the front and rear walls along the inboard region, to provide an interference fit in a hole of standard inside diameter of 0.037 to 0.043 inch.

The novel features of the invention are set forth with particularity in the appended claims. The invention will be best understood from the following description when read in conjunction with the accompanying drawings.

BRIEF DESCRIPTION OF THE DRAWINGS

FIG. 4B is a sectional view similar to FIG. 4A, for a minimum size hole.

FIG. 5 is a front elevation view of the contact of FIG. 2.

FIG. 6 is a left side elevation view of the contact of FIG. 5.

FIG. 7 is a right side elevation view of the contact of FIG. 5.

FIG. 8 is a rear elevation view of the contact of FIG. 5.

FIG. 9 is a front elevation view of a plurality of fully formed contacts held on carrier strips.

FIG. 10 is a front elevation view of the contacts and carrier strips of FIG. 9 during an earlier forming stage.

DETAILED DESCRIPTION OF THE INVENTION

Figure 1:
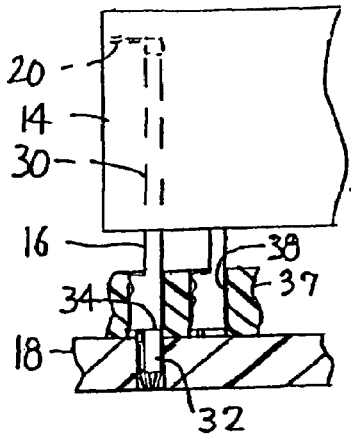
FIG. 1 is a partial side view of a combination of contacts and a circuit board, and a plastic header with the contacts shown mounted on a component housing.
Figure 3:
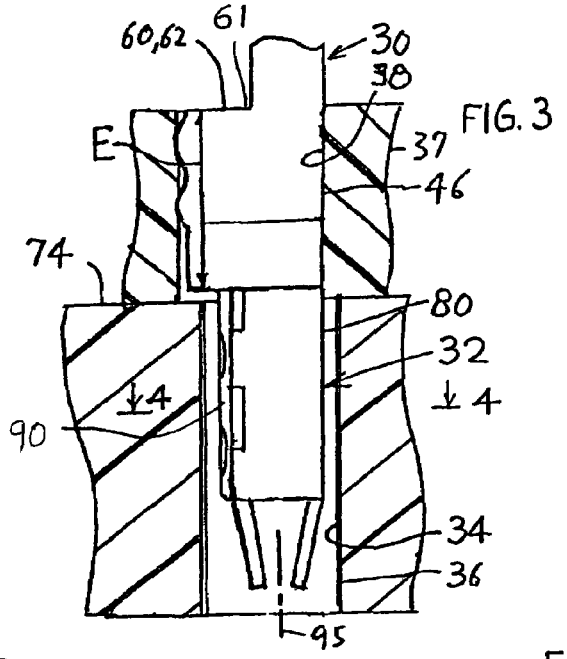
FIG. 3 is a sectional side view showing the inboard region of the contact lying in a circuit board hole and also showing a lower portion of the contact top region.

FIG. 1 illustrates a system 10 wherein a circuit component 12 has a housing 14 and has a plurality of contacts 16 that connect to traces on a circuit board 18. The contacts have upper ends that each connects to a conductor 20 in the component housing. As also shown in FIG. 3, each contact has a top region 30 that lies above the circuit board and has an inboard region 32 that lies primarily in a hole 34 in the circuit board (and possibly extends slightly below the bottom of the board). The holes in the circuit board are plated so they each have a plating 36. The system also includes a plastic header 37 with holes 38 that receive a lower portion of the contact top region.

Figure 2:
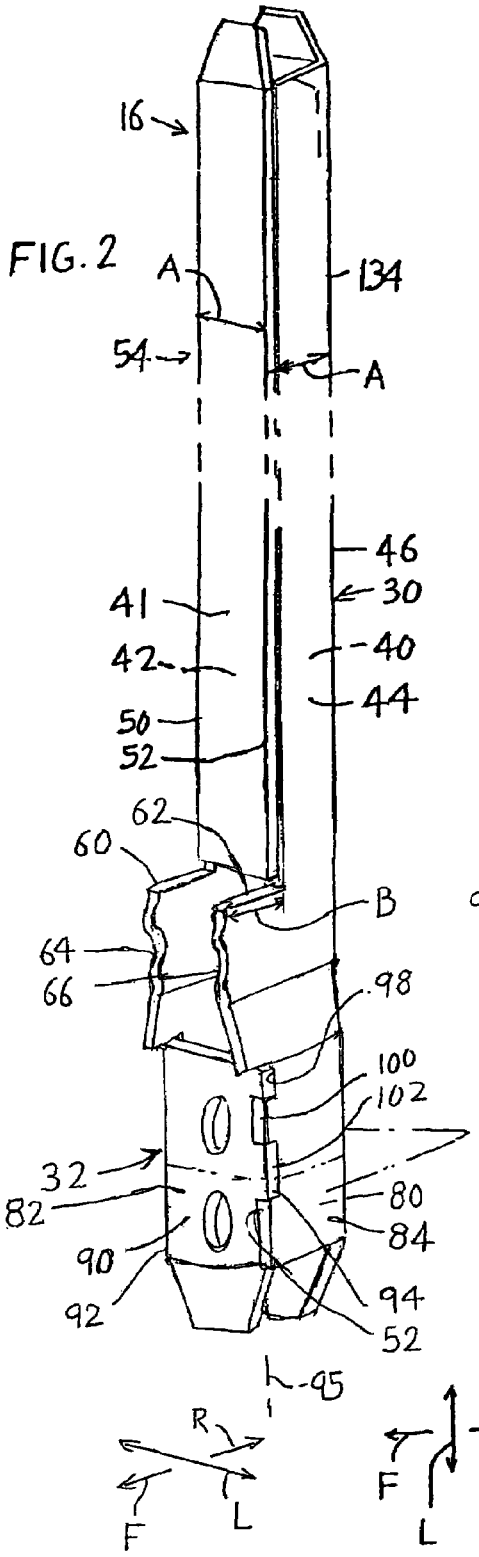
FIG. 2 is an isometric view of one of the contacts of FIG. 1.

As shown in FIG. 2, the contact is of generally box shape along its height, that is, it has four sides of a rectangular tubular shape. It has rear and front walls 40, 41 and has a pair of laterally L opposite side walls 42, 44 that extend forwardly F from laterally opposite side edges 46 of the rear wall. The side walls have front ends 50, 52 that extend a predetermined distance A forward of the rear wall along much of the length of the contact top region, along an upper portion 54 thereof.

The contact is first inserted into the header 37 (FIG. 1). The header is pressed down to insert each contact into the circuit board hole 34 by pressing against upwardly-facing shoulders 60, 62 of the contact and the header. FIG. 3 shows that inner parts 61 of the shoulders lie directly over the front wall 90 of the inboard region 32. The shoulders are made readily accessible by forming the side walls 42, 44 with forward projections 64, 66. The forward projections extend additional distances B forward of the front ends 50, 52, which are preferably at least 25% of the distance A, to form shoulder portions that are readily accessible from positions forward of the side wall front ends 50, 52. The shoulders 60, 62 are pressed down until they are at the same height as the top surface of the header 37.

The inboard portion 32 of the contact includes a rear wall part 80 (which is a downward extension of the rear wall 40) and first and second side wall parts 82, 84 (which are downward extensions of side walls 42, 44) that extend forwardly from the rear wall. The first side wall part 82 has an extension 90 that initially would extend forward, but which has been bent at 92 in a right angle (about 90°) bend about a contact axis 95, so the extension extends laterally L to form a front wall. The extension 90 has a free edge 94 that lies against the front edge of the second side wall at 52, at least when the contact inboard portion has been installed in the circuit board hole. Almost the entire height (at least 75% of the height) of the inboard portion 32 lies in the circuit board hole, in an interference fit therein.

The free edge 94 of the extension and the front edge 52 of the second side wall have recesses 98 that together form projecting fingers 100, 102 that interlock. The interlocking fingers limit the direction of sliding of the free edge 94 of the extension and front edge 52 of the second side wall on one another when they are pressed together as the inboard region is compressed during insertion into a board hole. Without such interlocking fingers applicant found that one of the ends slid vertically, causing the inboard portion to become skewed.

As shown in FIGS. 5 and 8, the front and rear walls 90, 80 each has a pair of holes 110, 112, with one hole 110 lying above an imaginary horizontal plane 114 that lies at the middle of the height of the inboard region, and the other hole 112 lying below the plane. The holes result in only narrow parts 120, 122 of the front and rear walls that must withstand compression forces when the inboard region is forced downwardly into the board hole. These narrow parts are compressed only slightly, but add to the resilience of the inboard region.

Figure 4A:
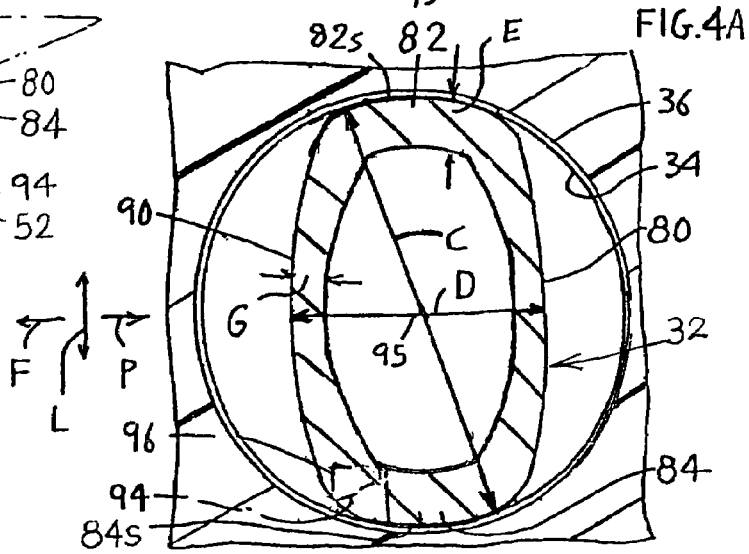
FIG. 4A is a sectional view taken on line 4-4 of FIG. 3.

FIG. 4A shows that the front and rear walls 90, 80 of the inboard region are longer than the opposite side walls 82, 84, so the inboard region is of largely rectangular cross section. When the inboard region is inserted, applicant finds that the laterally opposite walls bend outwardly. As a result, the wall surface 82*s*, 84*s* conform to the plated hole to make large area facewise contact with the laterally opposite walls of the holes.

The plated circuit board hole 34 has a standard inside diameter of 0.037 to 0.043 inch. The diagonal distance C between opposite sides 82, 84 of the contact inboard region (at its corners) is 0.044 to provide an interference fit with walls of the circuit board hole. The plated holes are commonly spaced at a pitch of 0.100 inch.

FIG. 4A shows the inboard region 32 in a hole 34 of about maximum diameter C (about 0.043 inch), while FIG. 4B shows the inboard region at 32B in a hole 34B of about minimum diameter (about 0.037 inch), showing that the configuration of the inboard region changes. The extension, or front wall 90 and the rear wall 80 each are initially (when not in the circuit board hole) bent about vertical axes to have convex outside surface as seen in FIG. 4A, to facilitate further convex bending when the inboard region is forced into the circuit board hole.

FIGS. 9 and 10 show contacts at two stages of manufacture, lying on carriers 130, 132 at a pitch P of 0.100 inch. When applicant bent the four walls 80, 82, 84, 90 (FIG. 4) applicant found that the material was not wide enough to have the interlocking finger ends 94, 96 interlock. Applicant lengthened the walls 80, 90 slightly by coining the walls to reduce their thickness from an initial thickness E of 5 mils (one mil equals one thousandth inch) to a thickness G of 3.5 mils. The coining operation which reduced the thickness by 30%, also increased the strength of the copper contact sides while increasing the end wall lengths.

FIGS. 6 and 7 show that the front edges 70, 72 of the forward projections 64, 66 undulate and have protuberances 71. As shown in FIG. 3 the protuberances form an interference fit in the holes 38 of the plastic header. FIG. 10 shows that the undulating front edges are formed in a piece of sheet metal that forms the contacts.

Applicant has described the contact as extending vertically and the circuit board having an upper face, to describe the invention as illustrated in the drawings. However, it should be realized that the contacts and circuit board can be used in any orientation.

Applicant has constructed and successfully tested contacts of the type illustrated and described. Each contact was formed of sheet copper of 0.005 inch thickness (except at the coined parts), had a longitudinal length A and width A of 0.025 inch along the upper portion of its top region, and a projection length B of 0.014 inch. The inboard region had a lateral and diagonal width C (FIG. 4) of 0.044 inch and longitudinal length D of 0.026 inch. The overall height of the contact (including its top and inboard regions) was 0.702 inch and the top region lower portion had a height E of 0.090 inch.

Thus, the invention provides a contact and a combination of a contact formed of sheet metal and a circuit board with a plated hole, wherein the contact has a contact top region with a lower portion that enables easy insertion of the contact in a circuit board hole, and has a contact inboard region that assures a tight resilient fit in the board hole. The contact is of generally U-shape cross-section along its length, with the opposite sides of the contact having forward extensions along the lower portion of the top region, to form upwardly and downwardly facing shoulders that facilitate contact insertion into the circuit board hole. Along the inboard portion, a first side wall has an extension that is bent to form a front wall, and the front wall has a free end that abuts the front edge of the second side wall. The adjacent edges of the extension and of the second side wall form interlocking fingers. The front and rear walls have holes that leave narrow wall portions that can compress slightly. The cross-section along the inboard region is in the form of an elongated rectangle that forms four corners.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. The combination of a circuit board that has a plated hole, and a plurality of electrical contacts each formed of sheet metal, each contact having an inboard region bent into a tubular shape and with at least a portion of said inboard region lying in one of said plated holes and each contact having a top region that projects above an upper face of the circuit board, wherein:

said inboard region of each contact has a vertical axis and has laterally opposite inboard side walls on laterally opposite sides of said axis, said side walls having rear edges and having front edges, and said inboard region has a rear wall that merges with said side wall rear edges;

a first of said inboard side walls has an extension that extends from the front edge of said first side wall and that is bent to extend primarily parallel to said rear wall and that has a free edge that abuts the front edge of the second inboard side wall.

2. The combination described in claim 1 wherein:

said inboard region has an imaginary middle horizontal plane, and said rear wall and said extension each has a hole lying above said horizontal plane and a hole lying below said horizontal plane, whereby compressing forces are concentrated along the horizontal plane.

3. The combination described in claim 1 wherein:

said extension and said rear wall of said inboard region each are curved about vertical axes to have a convex outer surface prior to insertion of the inboard region into the plated hole, whereby to facilitate further bending during insertion into the circuit board plated hole.

4. The combination described in claim 1, wherein:

said second inboard side wall has a front end with at least one recess therein, and said extension free edge forms at least one projecting finger that projects into said recess.

5. The combination described in claim 1 wherein:

said side wall, rear wall and extension form a largely rectangular cross-section that is elongated in one direction, and that lies in an interference fit in said circuit board hole.

6. The combination described in claim 1 wherein:

the top region of each contact has laterally opposite side walls with rear edges and a rear wall that connects said rear edges of said side walls;

along a lower portion of said top region said side walls form forward projections that project forward of side wall front ends at locations above said lower portion, said forward projections having upwardly-facing upper shoulders for receiving downward forces to downwardly press said inboard regions into said circuit board hole.

7. The combination described in claim 6 wherein:

above said lower portion of said top region, said top region has a front wall that extends parallel to said rear wall and that has a free end.

8. The combination described in claim 1 wherein:

at least one of said walls in coined to a smaller thickness than the thickness of the sheet metal along said top region, to thereby increase the length of the coined wall.

9. The combination of a circuit board that has a plated hole and a plurality of electrical contacts each formed of sheet metal, wherein:

each of said contacts is vertically elongated and forms a column formed by a rear wall having laterally opposite edges and a pair of side walls that each extends forward from one of the rear wall edges;

said column having a top region that lies above the circuit board and an inboard region that lies in the circuit board;

along said inboard region a first of said side walls has an extension that is bent 90° to extend primarily parallel to said rear wall, said extension having a free edge that engages a front end of the second side wall;

said top region has a lower portion that lies immediately above an upper face of said circuit board, where said side walls each has a forward projection that forms a top shoulder.

10. The combination described in claim 9 wherein:

said contacts each has an inboard region wall that is coined, to decrease its thickness and increase its width.

11. An electrical contact formed of bent sheet metal with an inboard region bent into a tubular shape for insertion in an interference fit into a plated circuit board hole, said contact having a top region for lying in and below a housing of an electrical component and above said circuit board, wherein:

said top region is in the form of a vertically elongated column that has laterally opposite side walls and a rear wall that connects said laterally opposite side walls, said column including a lower column part where said laterally opposite side walls each has a forward projection that forms an upwardly-facing shoulder that can be pressed down to insert said inboard region into a circuit board hole;

said inboard region has a vertical axis and has laterally opposite inboard side walls on opposite sides of said axis, and a rear inboard wall that connects rear edges of said inboard side walls, a first of said inboard side walls has a front end forming an extension that is bent about said axis and that has an extreme edge that abuts a front edge of the second inboard side wall.

12. An electrical contact formed of bent sheet metal with an inboard region bent into a tubular shape for insertion in an interference fit into a plated circuit board hole, said contact having a top region for lying in and below a housing of an electrical component and above said circuit board, wherein:

said inboard region has a cross-section, as taken along said axis, which forms a closed loop with abutting edges of the sheet metal in the loop;

said closed loop is elongated in a first direction so opposite ends of the loop that are spaced in said first direction engage the walls of said circuit board hole of round cross-section along said axis, but opposite sides of the loop that are spaced in a second direction that is perpendicular to the first direction do not engage the walls of the hole.

13. An electrical contact formed of bent sheet metal with an inboard region (32) for insertion in an interference fit into a plated circuit board hole (34), said contact having a top region (30) for lying above said circuit board, wherein:

said inboard region (32) of said electrical contact has front and rear walls (90, 80);

said top region is in the form of a vertically elongated column that has laterally opposite side walls (42, 44) and a rear wall (40) that connects said laterally opposite side walls, said column including a lower column part where said laterally opposite side walls each has a forward projection (64, 66) that forms an upwardly-facing shoulder (60, 62) that can be pressed down to insert said inboard region into the circuit board hole;

said shoulders (60, 62) having portions (61) that lie directly over said front wall (90) of said inboard region and that lie directly over a region that lies between said front and rear walls (82, 80).

* * * * *